US006758379B1

(12) United States Patent
Elwell

(10) Patent No.: US 6,758,379 B1
(45) Date of Patent: Jul. 6, 2004

(54) COORDINATE LOOP HANGER

(75) Inventor: Robert Elwell, Stow, OH (US)

(73) Assignee: A & E Products Group, Secaucus, NJ (US)

( * ) Notice: Subject to any disclaimer, the term of this patent is extended or adjusted under 35 U.S.C. 154(b) by 0 days.

(21) Appl. No.: 10/458,885

(22) Filed: Jun. 11, 2003

(51) Int. Cl.[7] ..... A41D 27/22
(52) U.S. Cl. ..... 223/85; 223/88
(58) Field of Search ..... 223/85, 87, 88, 223/89

(56) References Cited

U.S. PATENT DOCUMENTS 2,753,143 A * 7/1956 Berlt ..... 248/317
2,998,172 A * 8/1961 Stefano ..... 223/88
4,007,861 A * 2/1977 Duester et al. ..... 223/85
4,416,401 A * 11/1983 King ..... 223/88
4,653,678 A * 3/1987 Blanchard et al. ..... 223/85
4,871,098 A * 10/1989 Bredeweg et al. ..... 223/85
5,803,321 A * 9/1998 Willinger et al. ..... 223/88
6,209,763 B1 * 4/2001 Rahmey ..... 223/88
2001/0015363 A1 * 8/2001 Rahmey ..... 223/96

* cited by examiner

*Primary Examiner*—John J. Calvert
*Assistant Examiner*—James G. Smith
(74) *Attorney, Agent, or Firm*—Amster, Rothstein & Ebenstein

(57) ABSTRACT

A hanger having an integrally molded plastic hanger body of inverted U-shaped construction defines a pair of horizontally spaced walls adapted to cooperatively define a support for the suspending means of another hanger. Each of the walls defines a tab pivotally connected adjacent the wall bottom for movement between an initial spaced-apart orientation of the tabs and an engaged orientation of the tabs wherein said tabs engage one another to cooperatively define the support.

15 Claims, 3 Drawing Sheets

COORDINATE LOOP HANGER

BACKGROUND OF THE INVENTION

The present invention relates to a hanger with an integrally molded plastic body and, more particularly, such a hanger defining a coordinate loop for the support of a second hanger.

Whether a hanger rack is mobile or stationary, it is desirable for the hanger rack to be able to suspend therefrom as many garment-supporting hangers as possible. However, if the hangers (and the garments supported thereby) are laterally aligned along the longitudinal axis of the hanger, there is clearly a limit as to the number of hangers (and garments) which may be so supported due to the combined thicknesses of the hangers and garments thereon. Any attempt to approach this limit may result in unacceptable squashing or creasing of the hanger-supported garments due to the close longitudinal proximity of the garments on the hanger rack. Further, when the limit is approached, the ability to spread the hangers, thereby to enable removal or even just viewing of a particular garment by a potential customer, may be severely diminished.

In order to overcome these problems, it is known to provide a hanger with means for supporting directly thereunder another hanger. In this manner, there may be suspended from a given rack at least two vertically displaced rows of hangers. Indeed, the hangers of the lower row may also be provided with means for supporting hangers directly therebelow so that there may be a plurality of three or more vertically spaced rows of hangers. Despite the wide variety of different mechanisms used to suspend one hanger beneath another, these mechanisms have not proven to be entirely satisfactory in use. Either the mechanisms have proven to be relatively fragile, so that in use they break and allow the lower hanger to drop away from the upper hanger, or they present manufacturing difficulties which slow the production of the hanger bodies and thereby increase the unit manufacturing costs for the hanger body. Additionally, the conventional mechanisms do not provide for easy access of the lower hanger thereto so that suspension of the lower hanger from the upper hanger, and its subsequent removal therefrom, is tiresome, time-consuming and difficult. These problems are especially evident where the hanger body is an integrally molded piece (that is, it is of unitary, one-piece integral construction made in a single plastic molding operation), and the mechanism must be designed so as to neither interfere with easy release of the molded hanger body from the mold nor unduly increase the time required for the molding operation.

The unsatisfactory nature of the conventional mechanisms is especially evident when the integrally molded plastic hanger body defines a pair of horizontally spaced walls. Typically such walls are substantially parallel and connected by a bight adjacent the tops thereof to define an inverted "U" cross section. In order to ensure a hanger body of limited thickness, the horizontally spaced walls are conventionally of such thinness and so closely spaced together that they do not lend themselves to incorporation of a sturdy mechanism for supporting another hanger therebelow.

Accordingly, it is an object of the present invention to provide in one embodiment a hanger with an integrally molded plastic body defining a pair of horizontally spaced walls incorporating a coordinate support for maintaining a hanger therebelow.

Another object is to provide such hanger wherein in one embodiment the coordinate support is formed without substantially increasing the hanger body molding time or presenting problems with release of the hanger body from the mold.

A further object is to provide such a hanger wherein in one embodiment the coordinate support is configured and dimensioned to easily and rapidly receive thereon the suspending means of a lower hanger.

It is also an object of the present invention to provide such a hanger wherein in one embodiment the hanger body has an inverted U-shaped cross section.

It is another object to provide such a hanger wherein in one embodiment the hanger body (and in particular the coordinate support) is simple and inexpensive to manufacture and use.

SUMMARY OF THE INVENTION

It is now been found that the above and related objects of the present invention are obtained in a hanger comprising a hanger body defining a pair of horizontally spaced walls, and means at the top of the hanger for suspending the hanger body on an external support. The improvement comprises the walls being adapted to cooperatively define, adjacent the bottoms thereof, a support for the suspending means of another hanger (the lower hanger). Each of the wails defines a tab pivotally connected to the wall bottom for movement between an initially spaced-apart orientation of the tabs and an engaged orientation of the tabs wherein the tabs engage one another to cooperatively define the support.

In a preferred embodiment the support is defined by the engagement of a male member extending from one tab and a female member extending from the other tab, the male and female members being telescopically engaged when the tabs are in the engaged orientation. The tabs in the initial spaced-apart orientation extend generally transverse to the walls and in the engaged orientation extend generally parallel to the walls. The tabs either releasably or non-releasably engage one another in the engaged orientation. Each tab is preferably substantially rigid adjacent the bottom thereof and substantially flexible adjacent the top thereof.

The hanger body is preferably formed of integrally molded plastic. Preferably, the walls of the hanger body are thin and substantially parallel, and the hanger body additionally defines a bight connecting the pair of walls adjacent the tops thereof. The hanger body defines a first space intermediate the walls, and the tabs define therebetween above the support a second space, the first and second spaces communicating with one another, thereby to facilitate placement of the suspending means of another hanger (the lower hanger) on the support and to facilitate its removal therefrom.

BRIEF DESCRIPTION OF THE DRAWINGS

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
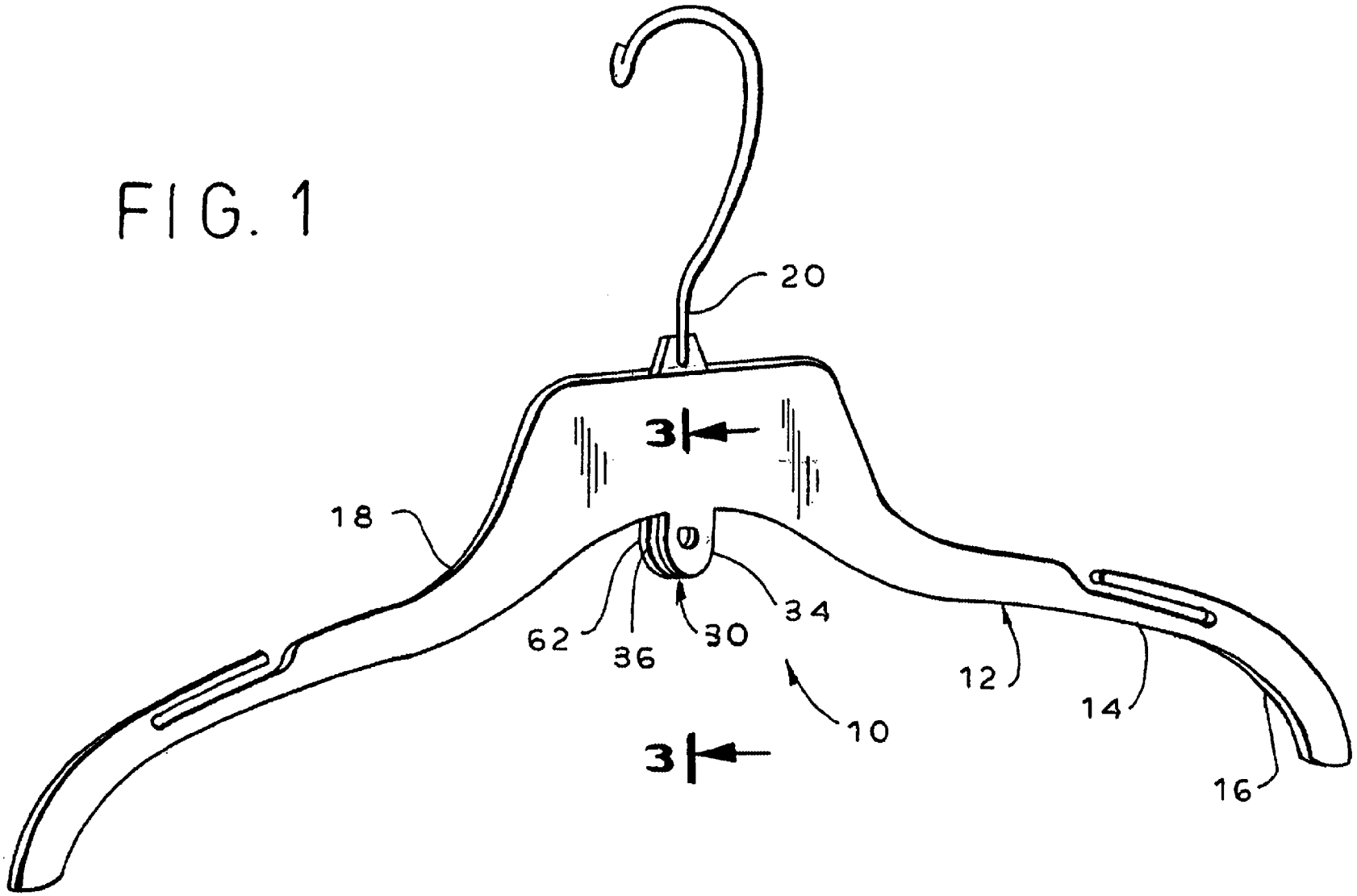
FIG. 1 is an isometric view of an upper hanger according to the present invention with the tabs in the engaged orientation to define the support.

Referring now to the drawing, and in particular to FIG. 1 thereof, therein illustrated is a hanger according to the present invention, generally designated by the reference numeral 10. In its conventional aspects, the hanger comprises an integrally molded plastic hanger body, generally designated 12, defining a pair of substantially parallel, horizontally spaced thin walls 14, 16 and a bight 18 connecting the walls 14, 16 adjacent the tops thereof (typically acting as a garment support surface), thereby to define an inverted "U" cross section. By way of example, each wall 14, 16 may have a thickness of about 1.25 millimeters, with the two walls have facing surfaces horizontally spaced by about 8.1 millimeters, although clearly these dimensions will vary with the intended weight of the garment to be supported on the hanger, etc. The integrally molded plastic hanger body 12 is preferably of unitary, one piece, integral construction made in a single plastic molding operation.

Means, generally designated 20, are provided adjacent the top of the hanger body 12 for suspending the hanger body on an external support (not shown). Typically the suspending means 20 is in a configuration of an open hook, but obviously other configurations may be used for this purpose. Where the hanger is not intended to be removed from an external support, the suspending means may define a closed loop intended to completely surround a section of the external support. The suspending means may be formed of the same plastic as the hanger body 12 or may be formed of a different material, such as metal, for added strength and rigidity. The suspending means 20 is conventionally secured to the hanger body 12 by means well-known in the art and, indeed, may be co-formed therewith in situ.

Figure 3:
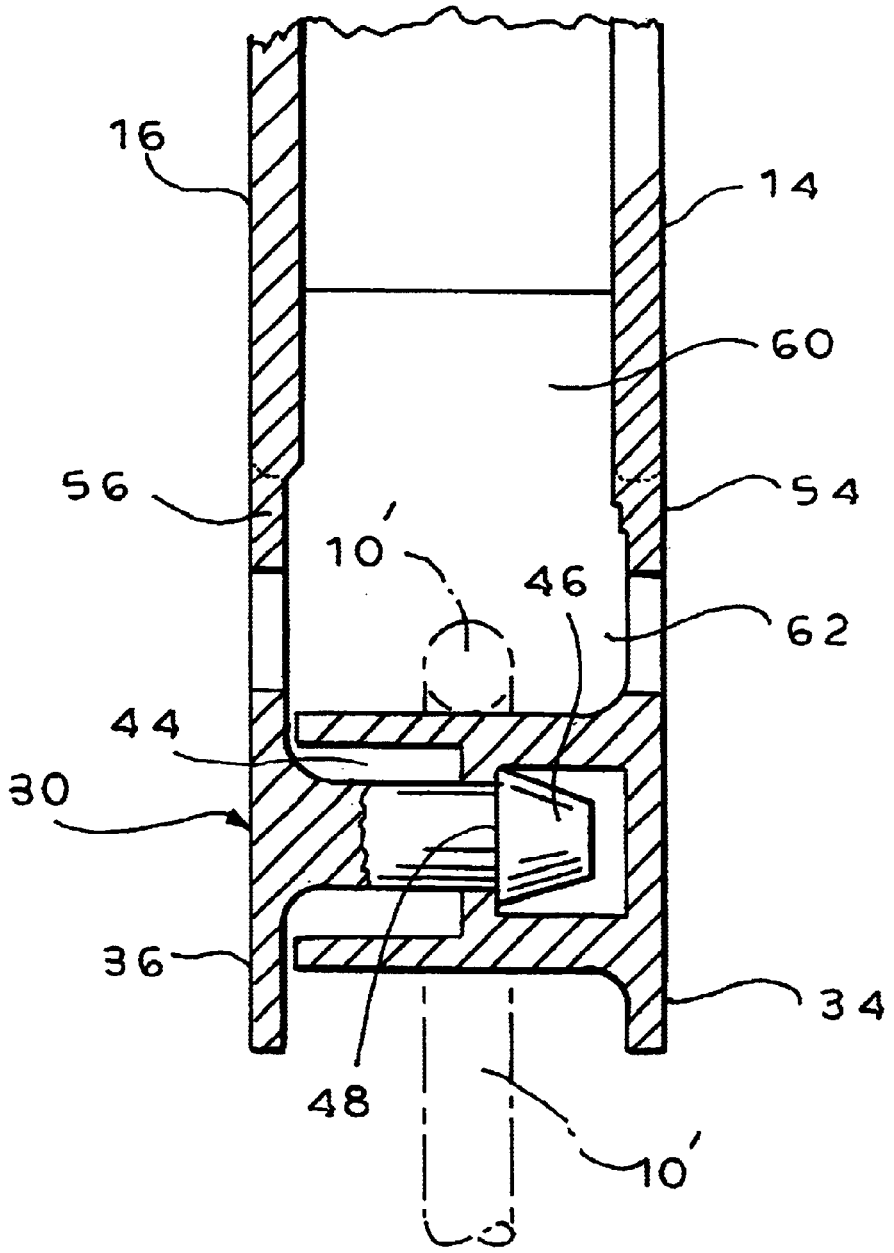
FIG. 3 is a fragmentary sectional view, to an enlarged scale, taken along the line 3—3 of FIG. 1, with a lower hanger being fragmentarily indicated in phantom line depending from the support of the upper hanger.

In its novel aspects, the hanger 10 of the present invention provides a support, generally designated 30, for suspending another hanger 10' therebelow. More particularly, the walls 14, 16 are adapted to cooperatively define, adjacent the bottoms thereof, a support 30 for the suspending means of another hanger 10' (as illustrated in FIG. 3). Thus, each of the walls 14, 16 defines a respective tab 34, 36 which is pivotally connected to the bottom of the wall for movement between two orientations. The tabs 34, 36 are preferably connected to the highest points of the wall bottoms, as most clearly seen in FIG. 1.

Figure 2:
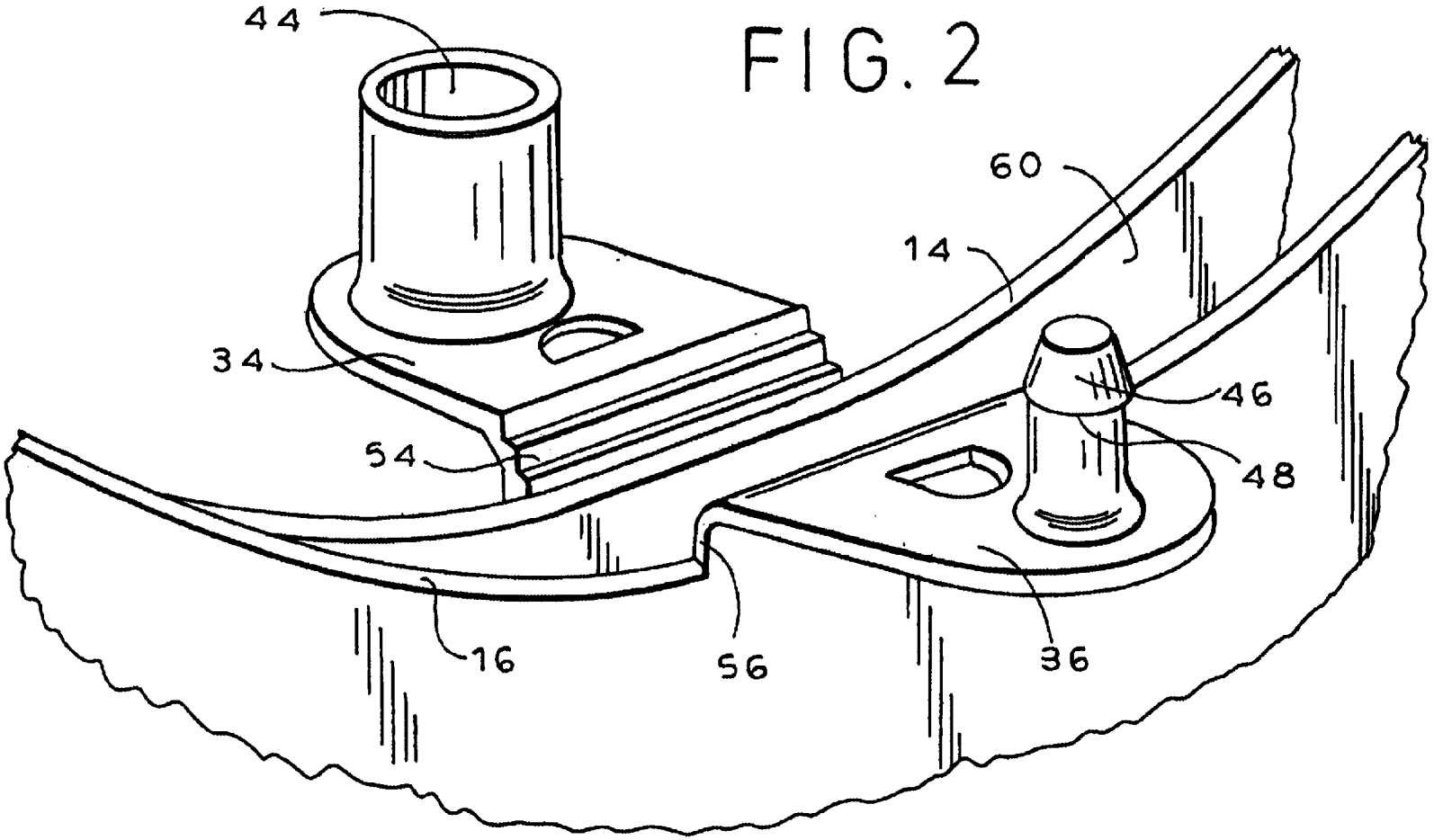
FIG. 2 is a fragmentary sectional view of the hanger, in an inverted orientation and to an enlarged scale, with the tabs in an initial space-apart orientation.

Referring now to FIGS. 2 and 3 as well, in the initial spaced-apart orientation of the tabs 34, 36 illustrated in FIG. 2, the tabs extend generally outwardly transverse and preferably perpendicular to the respective walls 14, 16, and in the engaged orientation illustrated in FIGS. 1 and 3, the tabs extend generally parallel and preferably substantially within the same vertical planes as the respective parallel walls 14, 16. The molding operation which creates the hanger body 12 (including the tabs 34, 36) creates the hanger body in the configuration illustrated in FIG. 2—that is, with the tabs 34, 36 extending outwardly transverse to the walls 14, 16 and preferably generally perpendicular thereto. The engaged orientation of the tabs is defined by the tabs 34, 36 engaging one another, as illustrated in FIGS. 1 and 3, to cooperatively define the support 30. As the two tabs 34, 36 cooperatively define the support 30, the support 30 is accurately characterized as a "coordinate support" in the sense that the two tabs work together harmoniously to form the desired result.

This is not to say that the two tabs 34, 36 are identical. In fact, referring to FIGS. 2 and 3, it will be appreciated that a female member 44 extends from the tab 34 and a male member 46 extends from the tab 36, the male and female members 44, 46 being oriented, configured and dimensioned to be telescopically engaged when the tabs 34, 36 are in the engaged orientation. The length and diameter of the male member 44 are typically about 8.1 mm and 4–5 mm, respectively.

Depending upon the interior configuration of the female member 44, the exterior configuration of the male member 46 and the relative dimensions of each, the tabs 34, 36 (and more particularly the female and male members 44, 46 thereof) may either releasably or non-releasably engage one another in the engaged orientation. Thus, the female and male members 44, 46 may establish, for example, an interference fit so that the tabs 34, 36 non-releasably engage or, for example, a press fit so that the tabs 34, 36 releasably engage. As illustrated in FIGS. 2 and 3, the head portion of the male member 46 defines a slight, somewhat resilient ridge 48 which engages a slight circumferential groove on the inner surface of the female member 44 to establish a secure but releasable engagement of the tabs 34, 36.

Preferably each tab 34, 36 is substantially rigid adjacent the bottom thereof (that is, in the portion about the female/male members 44, 46), but substantially flexible adjacent the top thereof (where it connects with the wall bottom). More particularly, preferably each of the walls 14, 16 may be considered as defining a substantially rigid tab 34, 36 and a flexible connecting member 54, 56 which pivotally supports the tab adjacent the wall bottom for movement between the initial spaced-apart orientation and the engaged orientation. Preferably the flexibility of the connecting members 54, 56 is limited to enabling the aforesaid pivotal movement.

Whether the tabs 34, 36 releasably or non-releasably engage in the engaged orientation, the suspending means of another (lower) hanger 10' may be easily and rapidly placed on or removed from the support 30. This is partially because the hanger body 12 defines a first space 60 intermediate the walls 14, 16 below the bight 18, and the tabs 34, 36 in the engaged orientation define therebetween above the support 30 a second space 62 (see FIG. 3). The first and second spaces 60, 62 preferably communicate with one another, thereby to facilitate movement of the suspending means of another (lower) hanger 10' over the support 30. Thus, the suspending means of the lower hanger 10' does not have to traverse the conventional narrow, low passageway over a support element defined by the upper hanger. The passageway defined by the engaged female and male members 44, 46 over support 30 is relatively wide (optionally as wide as the spacing between the inner surfaces of walls 14, 16) and quite high (as it extends through both the first and second spaces 60, 62).

Generally, the manufacture of the hanger body 12 will move the tabs 34, 36 from the initial spaced-apart orientation of FIG. 2 (as taken from the mold) to the engaged orientation of FIG. 1 (ready for use) in order to minimize the footprint of the hanger body 12, and thus the entire hanger 10, for transport and shipping. However, if preferred, the movement of the tabs from the initial spaced-apart orientation of FIG. 2 to the engaged orientation of FIG. 1 (ready for use) may be delayed until the suspending means of another (lower) hanger 10' is appropriately disposed and the support 30 then formed in situ to support the suspending means of the lower hanger 10'.

If desired, where the tabs 34, 36 are only releasably engaged, they may be separated for appropriate placement on support 30 of the suspending means of another (lower) hanger which defines a closed hook rather than an open hook.

To summarize, the present invention provides a hanger with an integrally molded plastic body defining a pair of horizontally spaced walls incorporating a coordinate support for maintaining a hanger therebelow. The coordinate support is formed without substantially increasing the hanger body molding time or presenting problems with release of the hanger from the mold. The coordinate support is configured and dimensioned to easily and rapidly receive thereon the suspending means of the lower hanger. The hanger body (and in particular the coordinate support) is simple and inexpensive to manufacture and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. In a hanger comprising:

(A) a hanger body defining a pair of horizontally spaced walls; and (B) means at the top of said hanger body for suspending said hanger body on an external support;

the improvement wherein:

said walls are adapted to cooperatively define, adjacent the bottoms thereof, a support for the suspending means of another hanger;

each of said walls defining a tab pivotably connected to said wall bottom for movement between:

(i) an initial spaced-apart orientation of said tabs, and (ii) an engaged orientation of said tabs wherein said tabs engage one another to cooperatively define said support.

2. The hanger of claim 1 wherein said support is defined by the engagement of a male member extending from one tab and a female member extending from the other tab, said male and female members being telescopically engaged when said tabs are in said engaged orientation.

3. The hanger of claim 1 wherein said tabs are connected to the highest points of said wall bottoms.

4. The hanger of claim 1 wherein said hanger body additionally defines a bight connecting said pair of walls adjacent the tops thereof.

5. The hanger of claim 1 wherein said tab is substantially rigid adjacent the bottom thereof and substantially flexible adjacent the top thereof.

6. The hanger of claim 1 wherein said tabs in said initial spaced-apart orientation extend generally transverse to said walls and in said engaged orientation extend generally parallel to said walls.

7. The hanger of claim 1 wherein said tabs non-releasably engage in said engaged orientation.

8. The hanger of claim 1 wherein said tabs releasably engage one another in said engaged orientation.

9. The hanger of claim 1 wherein said hanger body defines a first space intermediate said walls, and said tabs define therebetween above said support a second space, said first and second spaces communicating with one another, thereby to facilitate placement of the suspending means of another hanger on said support and to facilitate its removal therefrom.

10. The hanger of claim 1 wherein said walls are thin and substantially parallel.

11. The hanger of claim 1 wherein said hanger body is formed of integrally molded plastic.

12. In a hanger comprising:

(A) an integrally molded plastic hanger body defining a pair of horizontally spaced, substantially parallel thin walls and a bight connecting said pair of walls adjacent the tops thereof; and (B) means adjacent the top of said hanger body for suspending said hanger body on an external support;

the improvement wherein:

said walls are adapted to cooperatively define, adjacent the bottoms thereof, a coordinate support for the suspending means of another hanger;

each of said walls defining a substantially rigid tab and a flexible connecting member pivotably supporting said tab adjacent said wall bottom for movement between:

(i) an initial spaced-apart orientation of said tabs, and (ii) an engaged orientation of said tabs wherein said tabs engage one another to cooperatively define said coordinate support;

said tabs in said initial spaced-apart orientation extending generally transverse to said walls and in said engaged orientation extending generally parallel to said walls;

a male member extending from one tab and a female member extending from the other tab, said male and female members being telescopically engaged to define said coordinate support when said tabs are in said engaged orientation.

13. The hanger of claim 12 wherein said tabs non-releasably engage in said engaged orientation.

14. The hanger of claim 12 wherein said tabs releasably engage one another in said engaged orientation.

15. The hanger of claim 12 wherein said hanger body defines a first space intermediate said walls, and said tabs define therebetween above said coordinate support a second space, said first and second spaces communicating with one another, thereby to facilitate placement of the suspending means of another hanger on said coordinate support and to facilitate its removal therefrom.

* * * * *